US010676329B2

(12) United States Patent
Carmel

(10) Patent No.: US 10,676,329 B2
(45) Date of Patent: Jun. 9, 2020

(54) BALANCED CANTILEVERED FEEDING APPARATUS

(71) Applicant: Sky-Line Cranes & Technologies Ltd., Barkan (IL)

(72) Inventor: Aviv Carmel, Hod Hasharon (IL)

( * ) Notice: Subject to any disclaimer, the term of this patent is extended or adjusted under 35 U.S.C. 154(b) by 6 days.

(21) Appl. No.: 15/781,144

(22) PCT Filed: Nov. 30, 2016

(86) PCT No.: PCT/IL2016/051282

§ 371 (c)(1),
(2) Date: Jun. 3, 2018

(87) PCT Pub. No.: WO2017/094006

PCT Pub. Date: Jun. 8, 2017

(65) Prior Publication Data

US 2018/0346293 A1 Dec. 6, 2018

(30) Foreign Application Priority Data

Dec. 3, 2015 (IL) ..... 242937

(51) Int. Cl.
*B66C 1/10* (2006.01)
*B66C 23/70* (2006.01)
(Continued)

(52) U.S. Cl.
CPC ..... *B66C 23/706* (2013.01); *B66C 1/105* (2013.01); *B66C 1/24* (2013.01); *B66C 1/26* (2013.01); *B66C 1/68* (2013.01); *B66C 13/08* (2013.01)

(58) Field of Classification Search
CPC ..... B66C 23/53; B66C 23/72; B66C 23/74; B66C 2700/0314; B66C 2700/0392; B66C 1/28; B66C 13/063; B66C 13/08; B66C 1/105; B66C 1/10; B66C 1/24; B66C 13/18; B66D 3/18; E04G 21/168; B65G 49/0459
See application file for complete search history.

(56) References Cited

U.S. PATENT DOCUMENTS 462,230 A * 11/1891 Bader ..... A01D 45/02 56/74
1,545,346 A * 7/1925 Otilio ..... G01G 19/14 212/283

(Continued)

FOREIGN PATENT DOCUMENTS

FR 2551738 A1 * 3/1985 ..... B66C 1/105
JP 09227069 A 9/1997
JP 10218549 A 8/1998

*Primary Examiner* — Gregory W Adams
(74) *Attorney, Agent, or Firm* — Benjamin Aaron Adler

(57) ABSTRACT

A balanced cantilevered feeding apparatus for coupling with a jib, and a complementary method for its operation, configured to facilitate depositing and removing of a load through an opening in a building. The apparatus includes two spaced apart upright hoisting assemblies disposed on the jib, and a fly beam hoisted, balanced, and selectively positioned along a lateral axis by the two hoisting assemblies. A load securing member is mounted on a cantilevered extension portion of the fly beam, wherein the member extends beyond one of the two hoisting assemblies toward the building, and a counterweight is connected to the fly beam in the vicinity of another of the two hoisting assemblies.

16 Claims, 8 Drawing Sheets

(51) Int. Cl.

| | |
|---|---|
| ***B66C 1/24*** | (2006.01) |
| ***B66C 13/08*** | (2006.01) |
| ***B66C 1/26*** | (2006.01) |
| ***B66C 1/68*** | (2006.01) |

(56) References Cited

U.S. PATENT DOCUMENTS 2,859,884 A * 11/1958 Pearce ..... E04G 21/16 52/745.11
3,513,987 A * 5/1970 Seyff ..... B66C 13/00 212/282
3,675,961 A * 7/1972 Wheeler ..... B66C 1/105 294/67.1
3,955,844 A * 5/1976 de Castella ..... B66C 1/105 294/67.1
3,994,401 A * 11/1976 Tax ..... B66C 11/16 212/228
3,999,672 A * 12/1976 Brock ..... B60P 3/40 414/461
4,360,112 A * 11/1982 Brewer ..... B66C 17/06 105/163.1
4,648,647 A * 3/1987 Patton ..... B66C 1/105 212/195
4,671,721 A * 6/1987 Pratt ..... B66C 1/666 294/67.1
5,893,471 A * 4/1999 Zakula ..... B66C 13/08 212/316
7,708,325 B2 * 5/2010 Grant ..... B66C 13/08 294/81.3
7,861,872 B2 * 1/2011 Ng ..... B66C 1/104 212/316
8,000,835 B2 * 8/2011 Friz ..... B66C 13/04 294/67.5
8,127,949 B2 * 3/2012 Walker ..... B66C 23/82 212/231
8,127,950 B2 * 3/2012 Glickman ..... B66C 11/18 212/316
8,317,224 B2 11/2012 Schuyleman
8,789,682 B2 * 7/2014 Fisher ..... A63J 1/02 198/465.4
8,979,148 B1 * 3/2015 Hatton, II ..... B66C 1/105 212/196
9,617,123 B2 * 4/2017 Meyer ..... B66C 1/10
2014/0199154 A1 * 7/2014 Ammerlaan ..... B66C 1/10 414/800
2015/0203334 A1 * 7/2015 Moran ..... B66C 13/063 212/276

* cited by examiner

BALANCED CANTILEVERED FEEDING APPARATUS

FIELD OF THE INVENTION

The present invention relates generally to construction and building structures, and more particularly positioning of a load through an opening in a building.

BACKGROUND OF THE INVENTION

Construction is the process of forming buildings and structures. Cranes, and particularly tower cranes, are commonly used in construction of buildings to move and transport materials in the construction site. Tower cranes are adapted to lift heavy loads to various heights. Buildings are generally constructed as a shell with portals, such as openings for panels or windows and the like. It is often required to lift, position, insert, off-load, collect and pull bulky objects and heavy loads through the portal, such as a vacant window opening, to various levels of a wall of a tall building under construction.

However, cumbersome, difficult to handle and elaborated maneuvers are often required for positioning the load within a confined or covered location, especially during windy conditions. A common technique to insert loads into a building, despite the substantial accompanied effort, time and expenses, an outward extension of the floor is built. Such an extension is built in order to off-load materials at a specific level or floor by vertically lowering a load onto the floor extension, disconnected from the crane hooks, and thereafter moved into the building for use. Other solutions involve extending the hoisting of a beam of an overhead crane. The hoisting beam, which extends from its fulcrum such that the load is placed at one end of the beam, for allowing maneuvering, positioning and insertion of the load through the portals into the different stories of the building. Such beams usually incorporate a balancing counter-weight, which requires its displacement along the beam to balance against the particular load which may differ from a hoisting task to another. Such solutions still require difficult and time consuming maneuvers, and consume the invaluable resources of the general hoisting apparatus, typically a tower crane, at the expense of its use for other hoisting tasks.

U.S. Pat. No. 8,840,158 to Leibovitz, entitled "Lifting Beam", discloses an elongated load lifting beam with a balancing mechanism movably associated with the elongated beam and having a counterweight moved by movement apparatus for balancing the load.

French patent publication No. FR-2551738 to Theodor, entitled "Crane Spreader Bar for Hanging on the Hoisting Rope of a Crane, in particular a Building Crane", discloses a crane spreader bar as an attachment for a building crane for enabling loads hanging on one end of a jib-like work-arm part to be placed into wall openings located high up on a building, in which crane spreader bar the horizontal equilibrium position between zero load and maximum load can be set by virtue of the fact that the linear division of the work-arm part and the power-arm part carrying the counterweight can be changed by motor-actuated displacement of the suspension device of the crane spreader bar relative to the crane spreader bar. The motor actuation to maintain the equilibrium position can be automated by a level-control system carried by the crane spreader bar and having a level switch.

U.S. Pat. No. 8,979,148 to Hatton II, entitled "Fly Jib for a Crane and Method of Use", discloses a fly jib for a crane having a load block including a variable length beam to which a load can be connected. A rotation mechanism is connected to the variable length beam, and is connectable to the load block so that said rotational mechanism can selectively rotate the variable length beam with respect to the load block. A balance mechanism is connected to the variable length beam, the balance mechanism automatically keeps the variable length beam in a horizontal position.

U.S. Pat. No. 8,317,244 to Wesley, entitled "Apparatus and Method for Positioning an Object in a Building", is directed to a hoisting and positioning apparatus comprising a rigid boom having a hook at a distal end thereof. The hoisting apparatus further includes a front mount having a front boom aperture and a rear mount having a rear boom aperture, each being adapted for confining the boom to slidably move. The apparatus has a slip collar having a slip collar boom aperture therein for receiving the boom there through and an offset hoisting apparatus attachment having a flexible linkage fixed at a distal end thereof with the slip collar. The boom is selectively slid between a retracted and an extended position and the load is secured to the hook. The crane apparatus then lifts and positions the load to a building.

SUMMARY OF THE INVENTION

In accordance with one aspect of the present invention, there is thus provided a balanced cantilevered feeding apparatus for coupling with a jib, configured to facilitate depositing and removing of a load through an opening in a building. The balanced cantilevered feeding apparatus includes two spaced apart upright hoisting assemblies disposed on the jib, and a fly beam hoisted, balanced, and selectively positioned along a lateral axis by the two hoisting assemblies. The fly beam features at least one cantilevered extension portion extending beyond one of the two hoisting assemblies toward the building. The balanced cantilevered feeding apparatus further includes a load securing member mounted on the cantilevered extension portion positioned outwardly from the one of the two hoisting assemblies, the load securing member adaptable for engaging and supporting the load, for allowing depositing and removing the load through an opening in the building. The balanced cantilevered feeding apparatus further includes a counterweight connected to the fly beam in the vicinity of another of the two hoisting assemblies. The hoisting assemblies may be configured to selectively position the fly beam along a lateral axis by either a sliding over the jib or by changing hoist height when the jib is tilted to change its inclination. The jib may be functioning as the working arm of a crane, or mounted to the building above the opening, to another building facing the building, or to the building above the opening and to another building facing the building, optionally with a slewing mechanism. Additionally, the jib may be tiltably attached to the distal tip of a tiltable boom, where the fly beam is laterally positioned by tilting the jib or the boom.

In accordance with another aspect of the present invention, there is thus provided a method for facilitating depositing of a load through an opening in a building. First, hoisting, while maintaining a fly beam balanced, by two spaced apart upright hoisting assemblies disposed on a jib. Selectively attaching the load to a load securing member mounted on a cantilevered portion of the fly beam, the cantilevered portion extends beyond one of the two hoisting assemblies toward the building and connecting a counterweight in the vicinity of another of the two hanging points. Next, vertically aligning the fly beam with the opening in the building while maintaining the fly beam balanced, by vertically repositioning the fly beam by the two upright hoisting assemblies and selectively removing the load from the load securing member. The steps are reversed for picking the load through an opening in a building.

BRIEF DESCRIPTION OF THE DRAWINGS

The present invention will be understood and appreciated more fully from the following detailed description taken in conjunction with the drawings in which.

DETAILED DESCRIPTION OF THE EMBODIMENTS

Figure 1:
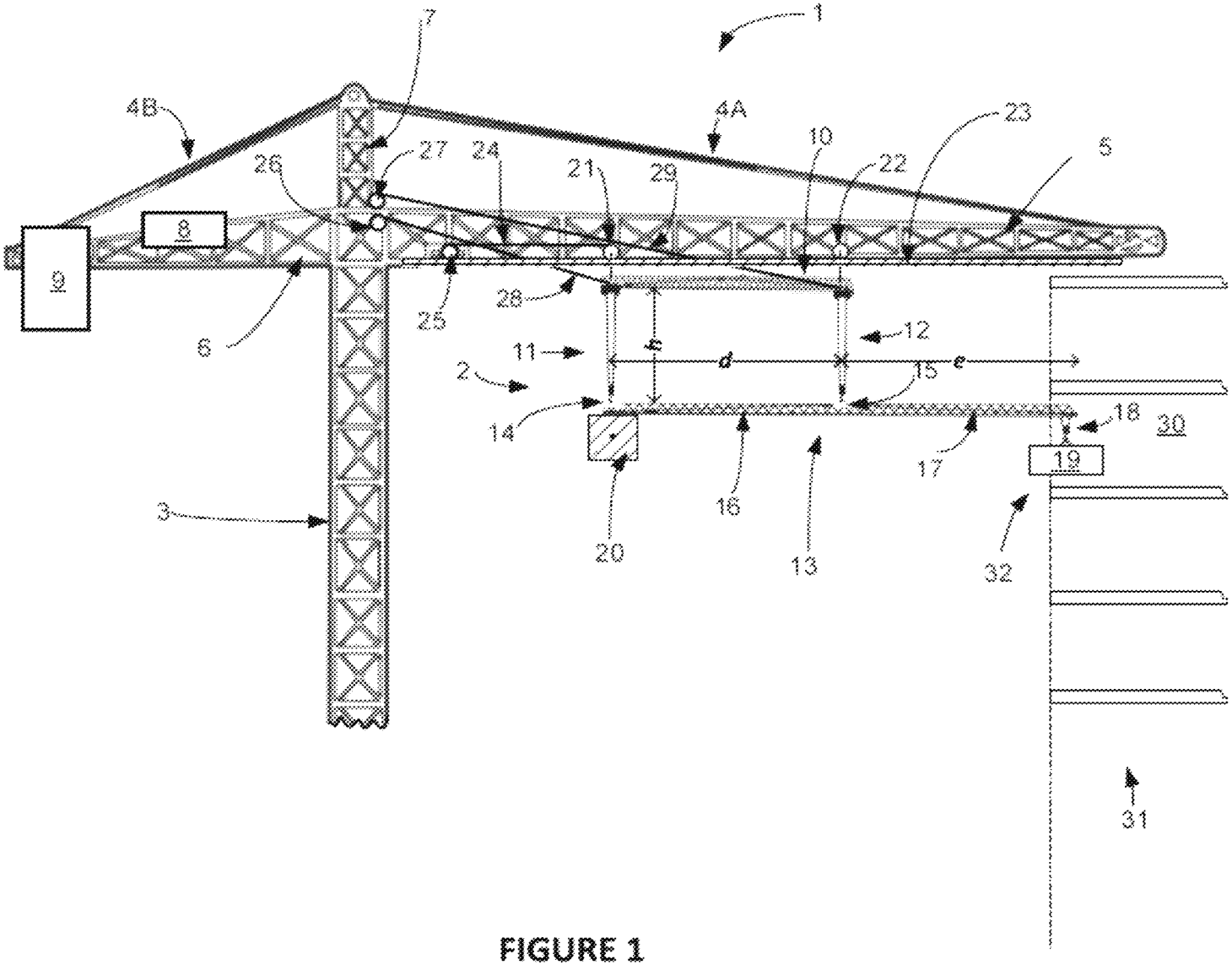
FIG. 1 is a schematic illustration of a tower crane equipped with a balanced feeding apparatus, constructed and operative in accordance with an embodiment of the present invention.

Tower cranes are typically located beside a building undergoing construction so that the tower crane can reach different parts of the building with ability to lift and drop materials. Insertion of a load into openings confined between an upper and lower floor is not possible with a regular hoisting assembly of the crane, and further means such as described by the prior art publications mentioned above are used to facilitate maneuvering and insertion of the load.

It is an object of the invention to provide a hoist system that is adapted for inserting a load onto a building structure through portals or openings of different levels. Such a needed apparatus selectively positions the load through the opening without requiring difficult balancing maneuvers, or complicated yaw, pitch, roll, panning, or other rotational maneuvers of the load and the hoisting apparatus. Moreover, such an apparatus would be easier and safer to place the load through an opening in the building. Drawbacks and deficiencies associated with prior art hoist systems are alleviated by the present invention which provides a hoist system for placing a load onto a building structure at a jobsite. The building structure may comprise any structure including conventional residential and office buildings, and any other application wherein an object must be hoisted and maneuvered into position for final installation.

In its broadest sense, the present invention overcomes the disadvantages of the prior art by providing a balanced cantilevered feeding apparatus for coupling with a jib, configured to facilitate depositing and removing a load through an opening in a building. The balanced cantilevered feeding apparatus includes two spaced apart upright hoisting assemblies disposed on the jib and a fly beam hoisted, balanced, and selectively positioned along a lateral axis by the two hoisting assemblies. The fly beam features at least one cantilevered extension portion extending beyond one of the two hoisting assemblies, preferably toward the building. The balanced cantilevered feeding apparatus further includes a load securing member mounted on the cantilevered extension portion positioned outwardly from one of the two hoisting assemblies, the load securing member is adaptable for engaging and supporting the load for allowing depositing and removing the load through an opening in the building. The balanced cantilevered feeding apparatus further includes a counterweight connected to the fly beam in the vicinity of another of the two hoisting assemblies. The balanced cantilevered feeding apparatus can be used with a variety of cranes by adaptation of or supplementation to the existing crane, or with a jib mounted to the building above the opening, to another building facing the building, or bridging two supports.

The present invention overcomes the disadvantages of the prior art by providing an apparatus for inserting a load to a building structure through portals or openings of different levels with a reduced amount of time, cost, risk of harm, and with enhanced stability, particularly in windy conditions. The present invention may relieve other lifting or hoisting apparatuses of the building site and prevent scheduling conflicts with the many other types of construction activities that typically require a hoisting apparatus. The present invention accomplishes these objectives.

Reference is now made to FIG. 1, which is a schematic illustration of a tower crane, generally referenced 1, equipped with a balanced feeding apparatus, generally referenced 2, constructed and operative in accordance with an embodiment of the present invention. Tower cranes generally include the tower or mast and a slewing unit which is attached to the top of the mast, the slewing unit includes the gear and the motor that allow the crane to rotate. Specifically, on top of the slewing unit of tower crane 1 are three parts: the working arm or long horizontal jib 5, the machinery arm or shorter horizontal counter jib 6, and the mast peak or apex 7 located on top of mast 3. Generally, long horizontal jib 5 is the portion of the crane that carries the load. Shorter horizontal machinery arm 6 contains the crane's motor that lifts the load and control electronics that drive the motor and the cable drum, all of these elements are generally disposed in machinery arm 6 and are designated by a block 8. Machinery arm 6 also includes a counterweight 9 which may be large and is typically comprised of concrete slabs. An operator's cab, where an operator sits and controls the crane, is disposed below apex 7. A fore pendant or jib suspension rod 4A extends between the top of apex 7 and the distal end of jib 5. A rear pendant or counter jib suspension rod 4B extends between the top of apex 7 and the distal end of counter jib 6. A trolley, from which the conventional hoisting hook block hangs, runs along the jib to move the load in and out from the crane's center. The elements so far mentioned, with the exception of balanced feeding apparatus 2, are common to conventional tower cranes.

Balanced feeding apparatus 2, includes an elongated trolley 10 which runs along jib 5 to move the load in and out from the crane's center. Trolley 10 extends along a portion of jib 5 and includes at least two hoisting assemblies, proximal hoisting assembly 11 and distal hoisting assembly 12. Proximal hoisting assembly 11 and distal hoisting assembly 12 are distanced one from the other at a distance d. A horizontal fly beam 13 hangs on upright hoisting assemblies 11 and 12, such as by hooks at hanging points 14 and 15. Hanging point 14 is located near the end of fly beam 13 proximal to mast 3 and hanging point 15 is located further distally at the same distance d from hanging point 14. A proximal portion 16 of fly beam 13 spans at distance d between hanging points 14 and 15. Fly beam 13 extends further distally along a distance e cantilevered from hanging point 15. Hoisting assemblies 11 and 12 are designed and synchronized to simultaneously lift and lower hanging points 14 and 15 at the same height h, thereby keeping fly beam 13 balanced, as long as no weight tips the balance. In such a configuration, fly beam 13 is confined to move with trolley 10 and hoisting assemblies 11 and 12 along a direction parallel to jib 13 such that no horizontal rotations of fly beam 13 are possible. Accordingly, only hanging point 15 may be a fulcrum about which fly beam 13 can pivot vertically, only to the extent that fly beam 13 would spontaneously pivot clockwise (in the constellation of FIG. 1)—when distal portion 17 tilts downwards while proximal portion 16 tilts upwards. A spontaneous counterclockwise (in the constellation of FIG. 1) vertical pivot of fly beam 13 is not possible because hoisting assembly 11 would not extend beyond height h.

According to the Law of the Lever, the balance of a lever can be determined by considering the balance of moments or torque of objects around a lever. Torque T equals the product of the weight m of an object and the distance d of the center of mass of the object from a lever. For example, the balance of fly beam 13 about the fulcrum at hanging point 15: $T_{16} \geq T_{17}$ and $m_{16}d \geq m_{17}e$, where the weight of horizontal fly beam 13 is negligible or equal over each distance d and e, $m_{16}$ is the total weight of portion 16 (including any hanging weights or loads), $m_{17}$ is the total weight of portion 17 (including any hanging weights or loads), $T_{16}$ is the total torque portion 16, and where $T_{17}$ is the total torque portion 17. If fly jib 13 has a uniform structure (e.g., triangular lattice work as shown), the balance of fly beam 13 is secured as long as d?e (without any hanging weights or loads).

A load securing member 18 is disposed at the distal end of fly beam 13, beyond hoisting point 15, and load securing member 18 is adapted for carrying a hanged load 19. It is noted that when trolley 10 slides toward the distal end of jib 5, fly beam 13 may extend past the distal end of jib 5. Counterweight 20 is disposed at the proximal end of fly beam 13, in the vicinity of hanging point 14.

For the sake of simplicity in calculations it can be assumed that fly beam 13 has a uniform structure and that hanging point 15 bisects horizontal fly beam 14, i.e., d=e. In such a case, it is noted that according to the Law of the Lever, as long as the weight of counterweight 20 exceeds or is equal to the weight of load 19 (the weight of load securing member 18 is assumed to be negligible or included in the weight of load 19), $m_{16} \geq m_{17}$, and the balance of fly jib 13 is be maintained. Regardless of if the distance d and distance e are equal, the weight of counterweight 20 can be selected, based on a simple calculation consisting of a maximum weight of load 19, lengths and weights of each part of fly beam 13, for maintaining the balance of fly beam 13.

To prevent any turning over of fly beam 13 due to excessive weight of load 19, an overload monitoring sensor may be installed in fly beam 13, such as a spirit level or a tilt sensor, incorporating a level sensing mechanism associated with fly beam 13 and operative to sense when fly beam 13 assumes an angular inclination which exceeds a predetermined value from horizontal equilibrium. A control mechanism associated with the level sensor is operative such that when the level sensing mechanism senses an angular inclination from horizontal beyond the predetermined value, the control prevents initial hoisting of a load seated on a surface before any further lifting of the load 19 occurs.

Trolley 10 includes wheels 21 and 22 that roll about rails 23 along jib 5 with the aid of cables 24 which are operated by motorized trolley winch 25, preferably disposed on jib 5 proximal to mast 3. Motorized hoist winches 26 and 27, preferably disposed in apex 7, operate cables 28 and 29, respectively, to synchronously lift and lower hanging points 14 and 15 of hoisting assemblies 11 and 12, respectively, while maintaining the balance of fly beam 13. It is noted that trolley 10 can be replaced by two discrete trolleys, in which case distinct driving means (wheels winches, cables, driving motors), are synchronized to slide each trolley along rails 23, spaced apart at a sufficient distance, preferably at the distance d, avoiding degeneration of the two upright hoisting assemblies 11 and 12 into an effective single fulcrum. If the distance between upright hoisting assemblies 11 and 12 is too small, they practically function as a single fulcrum, frustrating the prevention of possible horizontal panning or vertical pivoting about such single fulcrum.

The operation of balanced feeding apparatus 2 for raising a load 19, such as from the ground, and entering load 19 through an opening 32 of storey 30 of a building 31 is straightforward. First, hoisting fly beam 13 by hoisting assemblies 11 and 12 and sliding trolley 10 such that fly beam 13 may engage load 19 with load securing member 18. Next, attaching load 19 with load securing member 18 and sliding trolley 10 toward mast 3 allowing unobstructed lifting of load 19. Aligning vertically fly beam 13 to storey 30, jib 5 is rotated above building 31 directing load 19 to opening 32. Inserting the extension of fly beam 13 with load 19 by laterally repositioning fly beam 13 and distally sliding trolley 10. The reverse task of collecting a load from storey 30 is operated analogously by reversing these procedures.

Figure 2:
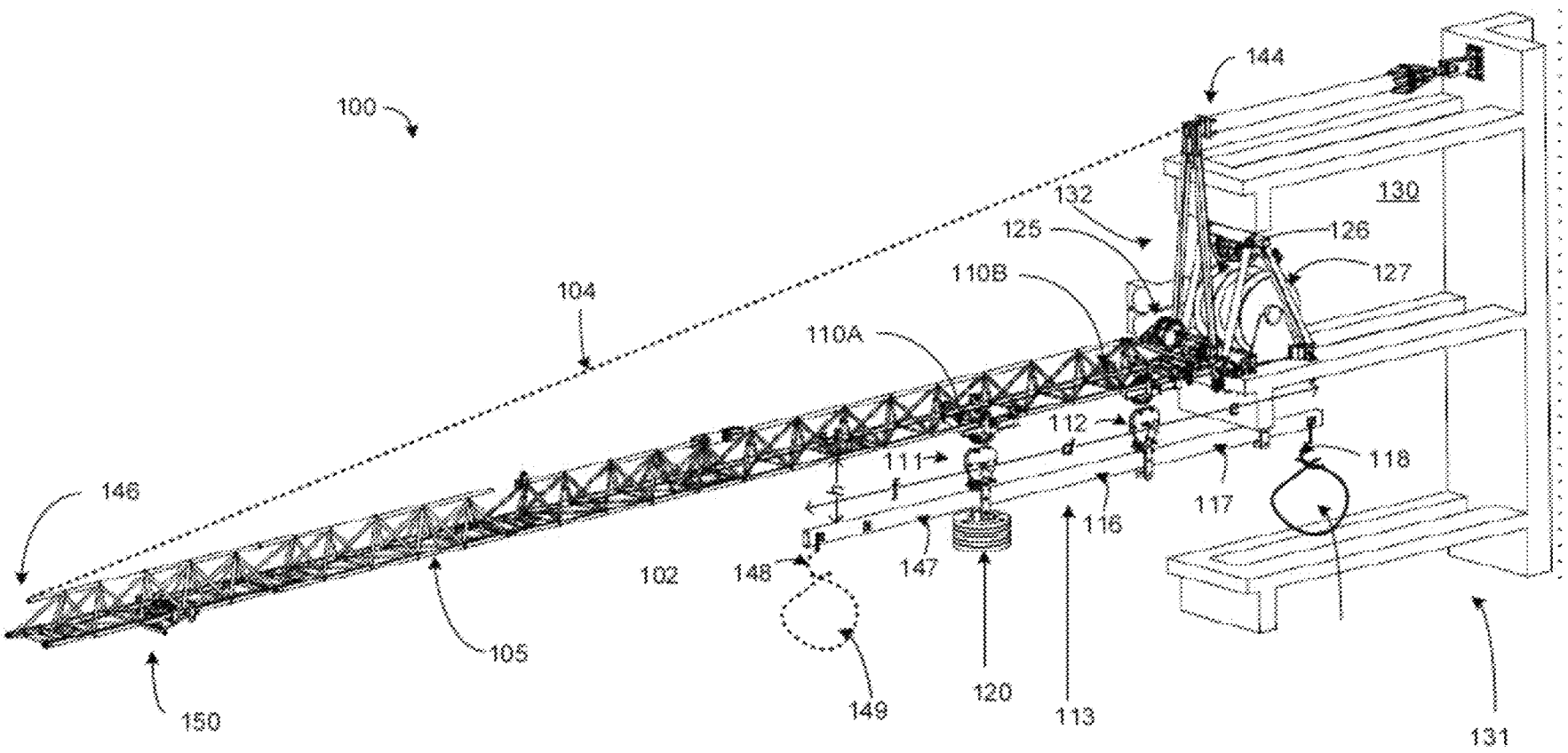
FIG. 2 is a perspective view illustration of a dedicated balanced feeding system, mounted on a building undergoing construction, constructed and operative in accordance with an embodiment of the present invention.
Figure 3:
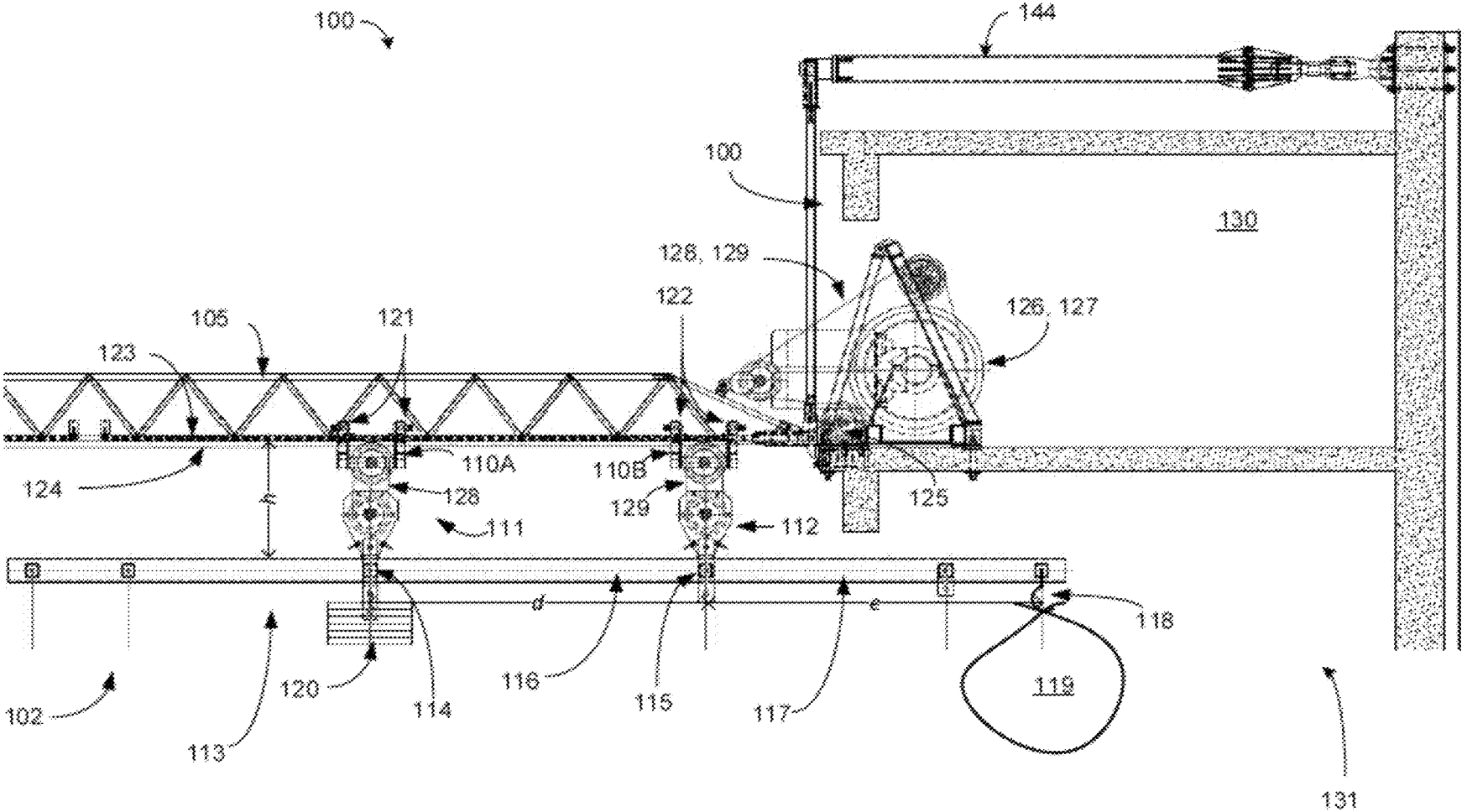
FIG. 3 is a side view illustration of the dedicated balanced feeding system of FIG. 2.

A dedicated balance feeding system may bridge between two side supports, such as two buildings, arch structures, or overhead beams. Reference is now made to FIGS. 2 and 3. FIG. 2 is a perspective view illustration of a dedicated balanced feeding system 100, mounted on a building, generally referenced 131, undergoing construction, constructed and operative in accordance with an embodiment of the present invention. FIG. 3 is aside view illustration of a dedicated balanced feeding system 100. Dedicated balanced feeding system 100 is designed to be installed in an opening 132 of storey 130 of building 131. Storey 130 may be selected to be the uppermost storey in building 131 for allowing the lifting a load 119 and its feeding into all stories of building 131. The use of a dedicated balanced feeding apparatus, such as system 100, with a dedicated jib mounted to building 131, relieves the need for a tower crane, or allows for concurrent work of both a tower crane for lifting and carrying across the job site as well as a balanced feeding apparatus for specialized lifting and carrying tasks related to and near building 131.

System 100 includes a dedicated jib 105, which is the working arm of system 100, and is supported at the proximal end of jib 105 by the floor of storey 130. Fixation assembly 144 is mounted to building 131 above storey 130, connecting jib 105 to building 131. Optional pendant or suspension rod 104 is connected to distal end 146 of jib 105 and to fixation assembly 144 or directly to building 131 above jib 105, horizontally supporting jib 105. Jib 105 is analogous to and functionally substitutes jib 5 of tower crane 1 of FIG. 1, while all of the parts of balanced feeding apparatus 2 may be installed with jib 105, with the slight modification regarding the disposition of extending portion 17 in the proximal side relative to jib 104 and building 131 (instead of distally relative to the definitions in FIG. 1) where the offset loading and positioning of loads is required. The use of a balanced feeding apparatus with a dedicated jib which is mounted to the building rather than with the jib of a tower crane serving a building site, relieves the tower crane which is usually used in the job-site for all lifting and carrying tasks, while the building-mounted dedicated system with a balanced feeding apparatus can be operated concurrently, without any obstruction.

Dedicated balanced feeding system 100 includes a balanced feeding apparatus 102 which features alternative elements relative to balanced feeding apparatus 2. Balanced feeding apparatus 102 includes two trolleys, distal trolley 110*a* and proximal trolley 110*b*, which run along jib 105 to move load 119 in and out from building 131. Trolley 110*a* includes proximal hoisting assembly 111 and trolley 110*b* includes distal hoisting assembly 112 which are distanced, one from the other at a distance d. Horizontal fly beam 113 hangs on upright hoisting assemblies 111 and 112, such as by adequate hinges, at hanging points 114 and 115. Hanging point 114 is located at a distal part of fly beam 113, distal to building 131, and hanging point 115 is located at a proximal point of fly beam 113, proximal to building 131. Hanging points 114 and 115 are separated by distance d, comprising a portion 116 on fly beam 113. Fly beam 113 extends further proximally along a distance e from hanging point 115. Hoisting assemblies 111 and 112 are designed and synchronized to simultaneously lift and lower hanging points 114 and 115 at the same height h, thereby keeping fly beam 113 balanced, as long as no weight or external force tips the balance. Load securing member 118 is disposed at the proximal end of fly beam 113, and is adapted for carrying a hanged load 119. It is noted that when trolleys 110*a* and 110*b* are slid toward the proximal end of jib 105, fly beam 113 extends further proximally beyond the proximal end of jib 105 (resting on the floor of storey 130), and thereby allow the offset of load 119 beyond the proximal end of jib 105 and into building 131. Counterweight 120 is disposed in the vicinity of hanging point 114. Trolleys 110*a* and 110*b* include wheels 121 and 122, respectively, that roll about rails 123 along jib 105 with the aid of cables 124, operated by a motorized trolley winch 125, preferably disposed on jib 105 proximal to building 131. Motorized hoist winches 126 and 127, preferably disposed over the floor of storey 130, operate cables 128 and 129, respectively, to synchronously lift and lower hanging points 114 and 115 of hoisting assemblies 111 and 112, respectively, while maintaining the balance of fly beam 113. It is noted that discrete trolleys 110*a* and 110*b* may be synchronized to slide along rails 123, while maintaining them spaced apart at a sufficient distance (not necessarily at the distance d). Fly beam 113 may further include another portion 147 which extends distally from hanging point 114 at a distance f. Such configuration allows using balanced feeding system 100 for offset feeding of loads into another building located distally—with openings facing building 131 and disposed below jib 105, such that balanced feeding apparatus 102 can be used to insert loads into such openings. In such a configuration, load 149 is hanged by hanging module 149 at the distal end of fly beam 113, and counterweight 120 is moved from hanging point 114 to hanging point 115.

Figure 4:
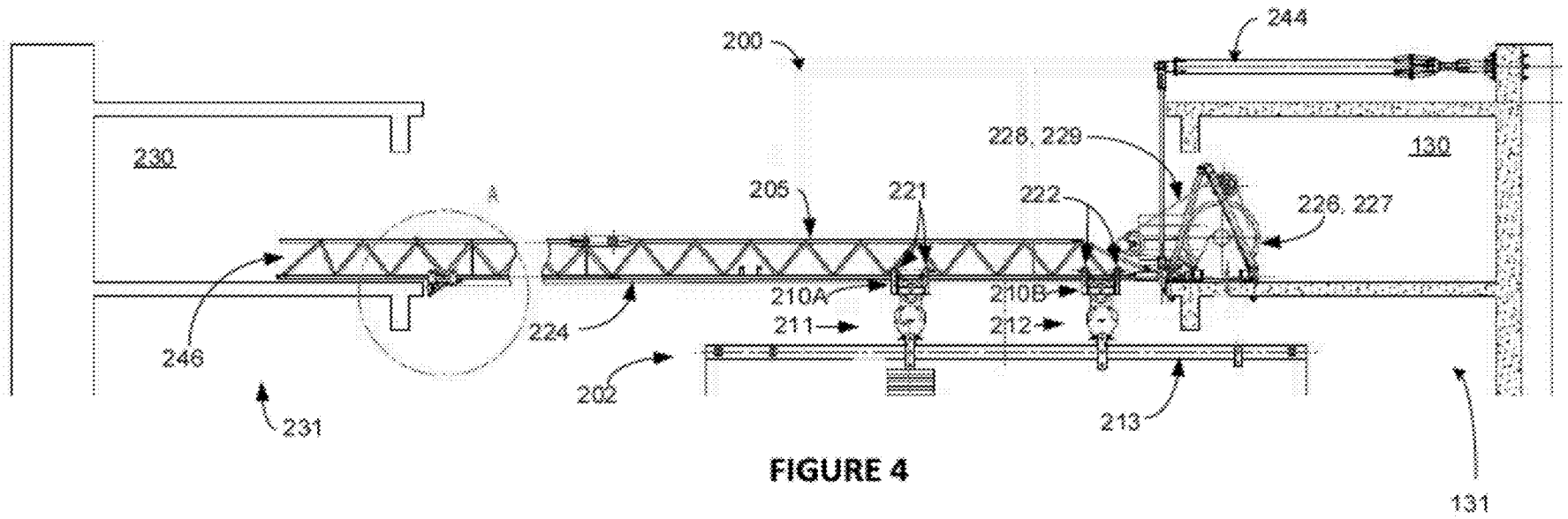
FIG. 4 is a side view illustration of a balanced feeding system for mounting between two buildings undergoing construction, constructed and operative in accordance with an embodiment of the present invention.
Figure 5:
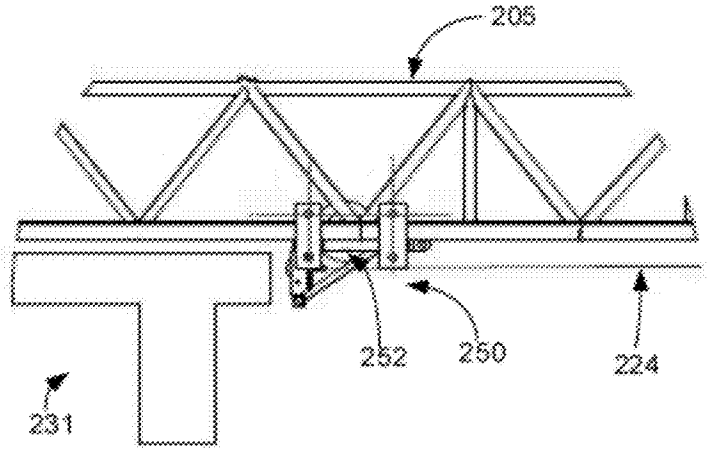
FIG. 5 is a zoomed in side view illustration of section A of FIG. 4, showing in detail a distal portion of the jib of the balanced feeding system of FIG. 4.
Figure 6:
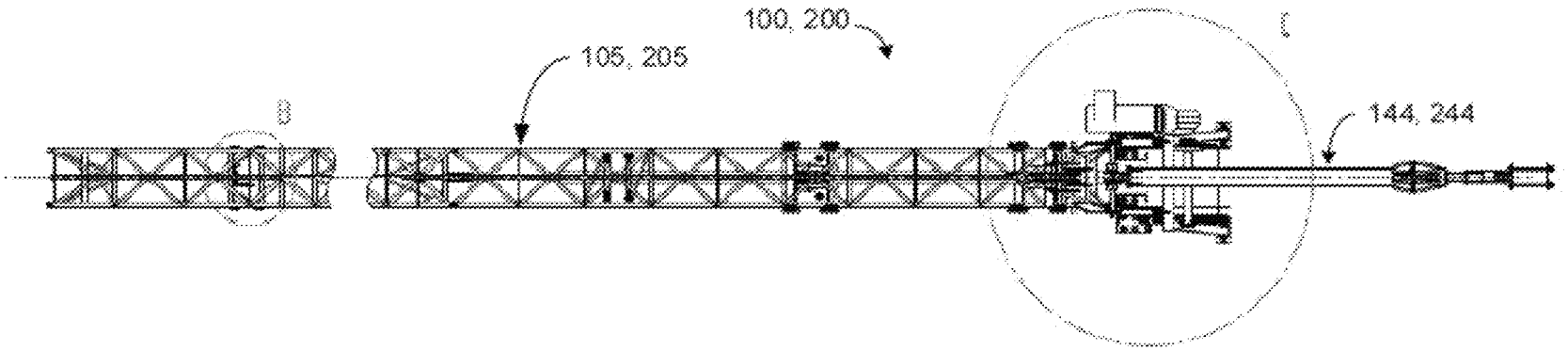
FIG. 6 is a top view illustration of the balanced feeding system of FIG. 2 or FIG. 4.
Figure 8:
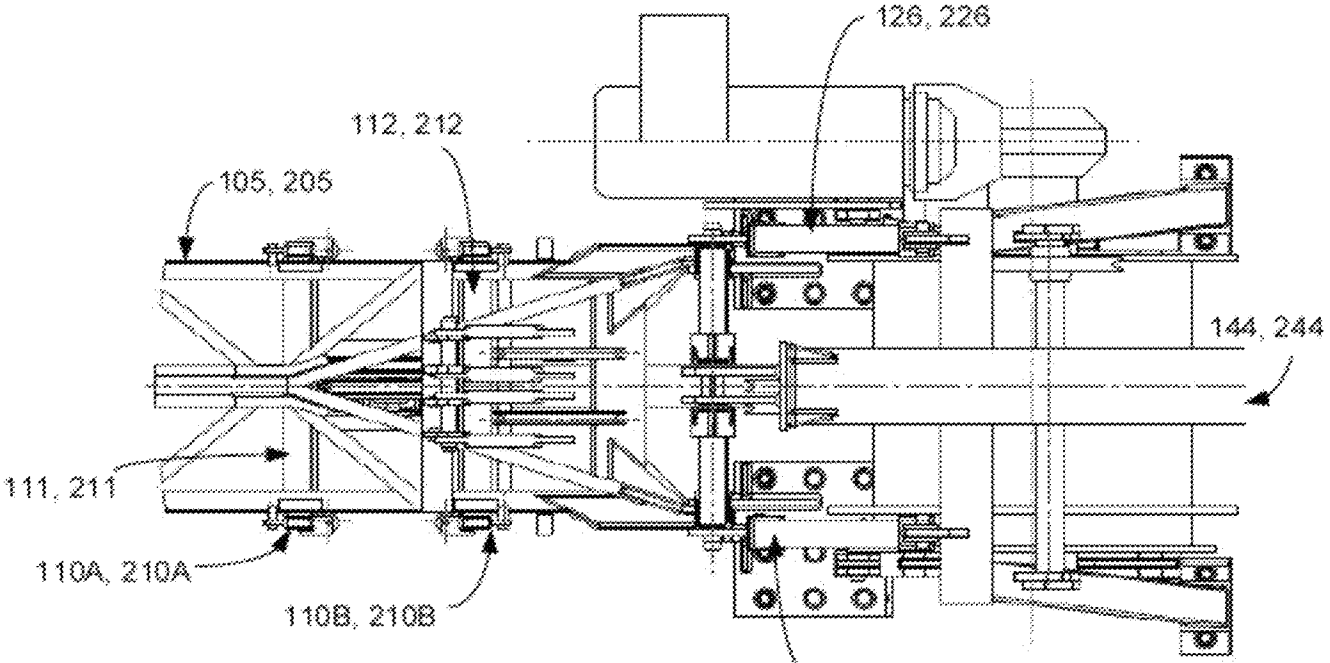
FIG. 8 is a zoomed in top view illustration of section C of FIG. 6, showing in detail a proximal portion of the balanced feeding system of FIGS. 2, 4 and 6.
Figure 7:
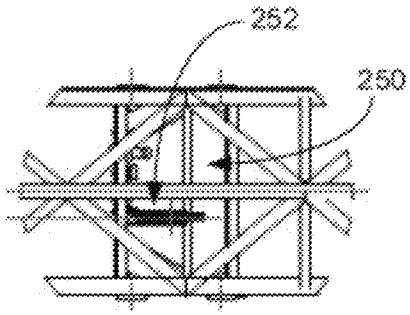
FIG. 7 is a zoomed in top view illustration of section B of FIG. 6, showing in detail a distal portion of the jib of the balanced feeding system of FIGS. 2, 4 and 6.

If two such buildings are facing each other, distal end 146 of jib 105 of balanced feeding system 100 may be seated on the floor of a story which is leveled with the floor of storey 130 of building 131. Reference is now also made to FIGS. 3 to 8. FIG. 4 is a side view illustration of a balanced feeding system 200 for mounting between two buildings, generally referenced 131 and 231, undergoing construction, constructed and operative in accordance with an embodiment of the present invention. FIG. 5 is a zoomed in side view illustration of Section A of FIG. 4, showing in detail a distal portion of jib 205 of balanced feeding system 200 of FIG. 4. FIG. 6 is a top view illustration of balanced feeding system 100 of FIG. 2 or balanced feeding system 200 of FIG. 4. FIG. 7 is a zoomed in top view illustration of Section B of FIG. 6, showing in detail a distal portion of jib 105 of balanced feeding system 100 of FIG. 2, or of jib 205 of balanced feeding system 200 of FIGS. 4 and 6. FIG. 8 is a zoomed in top view illustration of section C of FIG. 6, showing in detail a proximal portion of the balanced feeding system 100 of FIG. 2, or of the balanced feeding system 200 of FIGS. 4 and 6. Balanced feeding system 200 is similar to balanced feeding system 100 of FIG. 2. Jib 205 of balanced feeding system 200 is mounted to building 131 at storey 130 similar to system 100 of FIG. 2. Distal end 246 of Jib 205 is placed on the floor of storey 230 of building 231, which is leveled with the floor of storey 130 of building 131, thereby retaining jib 205 stabilized in a horizontal posture. In this configuration, pendant or suspension rod 104 of system 100 is redundant. Trolleys 210*a*, 210*b* slide along jib 205, where cables 224 drive wheels 221, 222 to propel trolleys 110*a*, 110*b* using pulleys 252. Pulleys 252 are incorporated in distal unit 250, which is removably disposed on jib 205 near the floor of storey 230. A similar distal unit 150 is disposed near distal end 146 of jib 105 of system 100.

Figure 10:
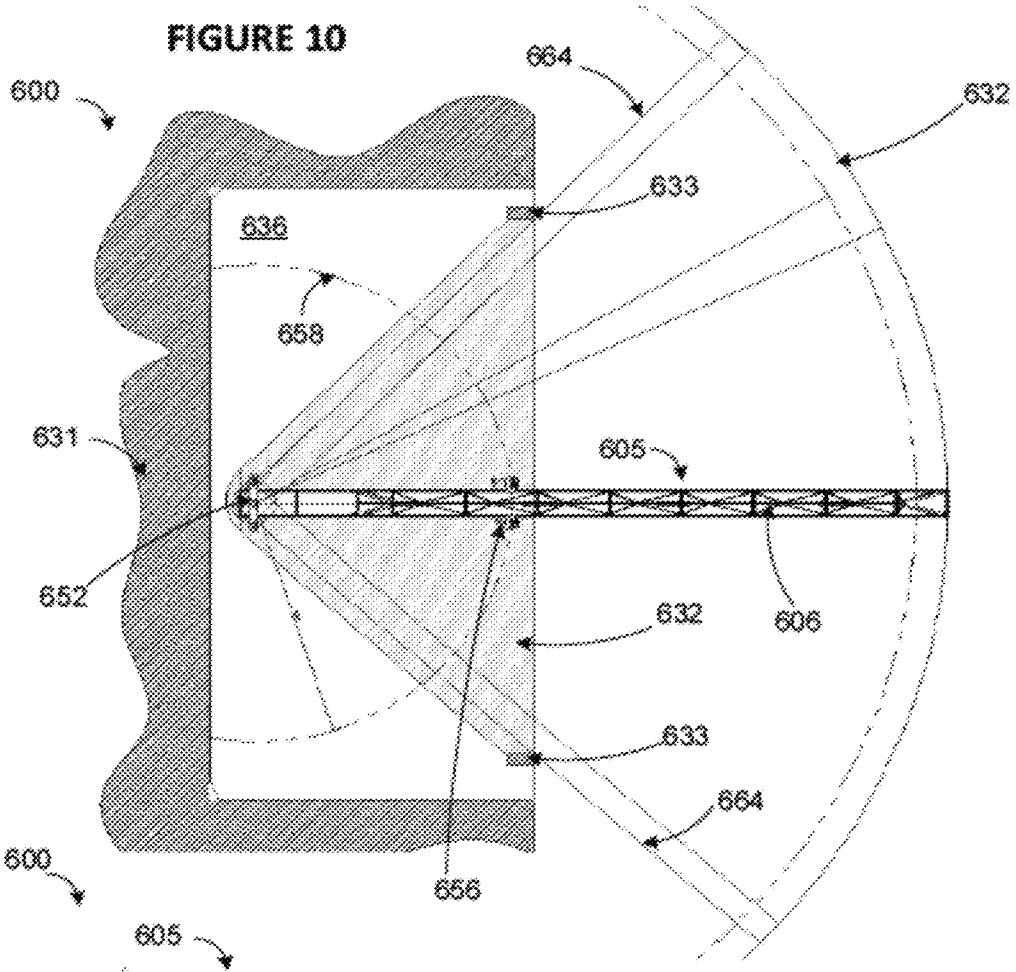
FIG. 10 is a top view of the feeding system of FIG. 9.
Figure 11:
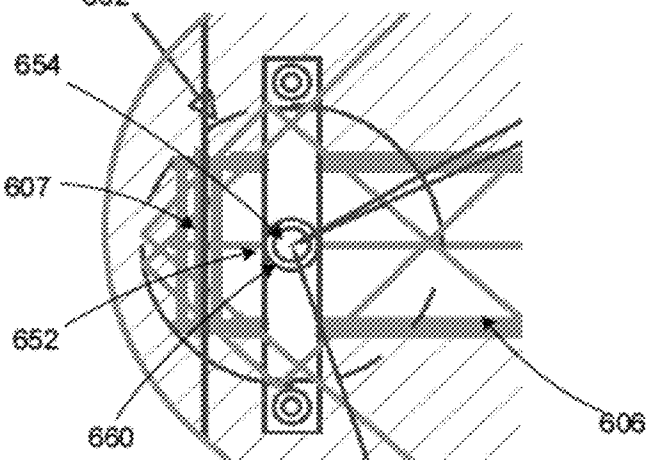
FIG. 11 is a zoomed in top view illustration of a portion of FIG. 10 showing part of the slewing mechanism of FIGS. 9 and 10 in further detail.
Figure 9:
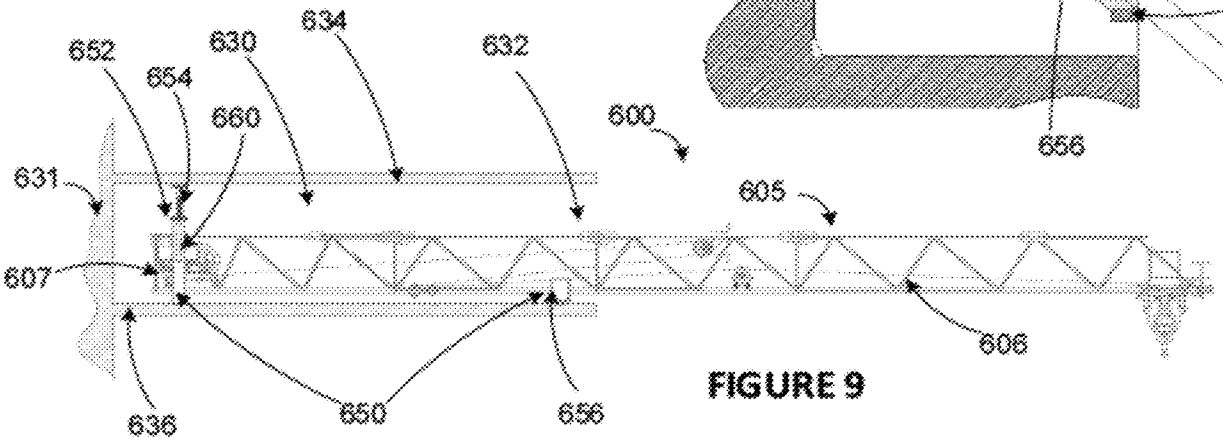
FIG. 9 is a schematic side view illustration of a dedicated balanced feeding system with a slewing mechanism, mounted on a building, constructed and operative in accordance with an embodiment of the present invention.

Reference is now made to FIGS. 9, 10, and 11. FIG. 9 is a schematic side view illustration of a dedicated balanced feeding system, generally referenced 600, with a slewing mechanism, generally denoted 650, mounted on a building, constructed and operative in accordance with an embodiment of the present invention. FIG. 10 is a top view of feeding system 600 of FIG. 9. FIG. 11 is a zoomed in top view illustration of a portion of FIG. 10 showing part of slewing mechanism 650, of FIGS. 9 and 10 in further detail;

Dedicated balanced feeding system 600 is similar to dedicated balanced feeding system 100 of FIGS. 2 and 3. Feeding system 600 is designed to be mounted on a building or another platform, such as in an opening 632 of storey 630 of a building 631, or on a top flat roof of a building, and operate with equivalence to feeding system 100, except for an added horizontal slewing motion, provided by slewing mechanism 650. Slewing mechanism 650 includes vertical axle 652 which includes a pole 654 secured to ceiling 634 and to floor 636 of storey 630. Slewing mechanism 650 further includes a support trolley 656 that supports jib 605 and can roll along a concentric path 658 over floor 636 about axle 652. Jib 605 is rotatably secured to pole 654 of axle 652 with adequate bearing 660. Axle 652 divides jib 605 into a working portion 606 and a short "tail" forming a counter portion 607 that rotates along a small concentric path 662 within a vacant space of storey 630. The slewing of jib 605 is activated and controlled by adequate driving means such as winches or a motor associated with jib 605, trolley 656, or axle 652. In the example of mounting jib 605 within storey 630, wherein jib 605 extends through opening 631, the span of slewing of jib 605 is confined to positions 664 by structural limitations of building 631, such as pillars 633. However, system 600 may be mounted on a flat portion of the roof of a building, and accordingly the slewing span may be entirely unobstructed through all around movement) (360°) if there are no obstructing elements over the top flat roof, or with structural obstructions that bring about mere exiguous confinement.

A balanced feeding system may be supported by jibs 605, allowing insertion of loads into openings in building 631 (or in opposing buildings) in analogy to the systems of FIGS. 2 to 8, with the difference of being optionally angled to the face of such openings, and with the added capability of collection and unloading loads over the ground at different locations in a larger ground loading area, thanks to the slewing capacity of system 600. This is especially advantageous as loads are often dispersed over a large ground loading area, wherein hoisting can be administered directly with system 600 over the entire loading area without requiring bringing the loads to a particular ground hoisting spot. It is noted that system 600 is not necessarily limited to use with a balanced feeding system and may be used with a simple hoisting assembly for conventional loading and unloading, taking advantage of its slewing ability (without feeding into openings requiring balanced extending cantilevered hoisting).

Figure 12:
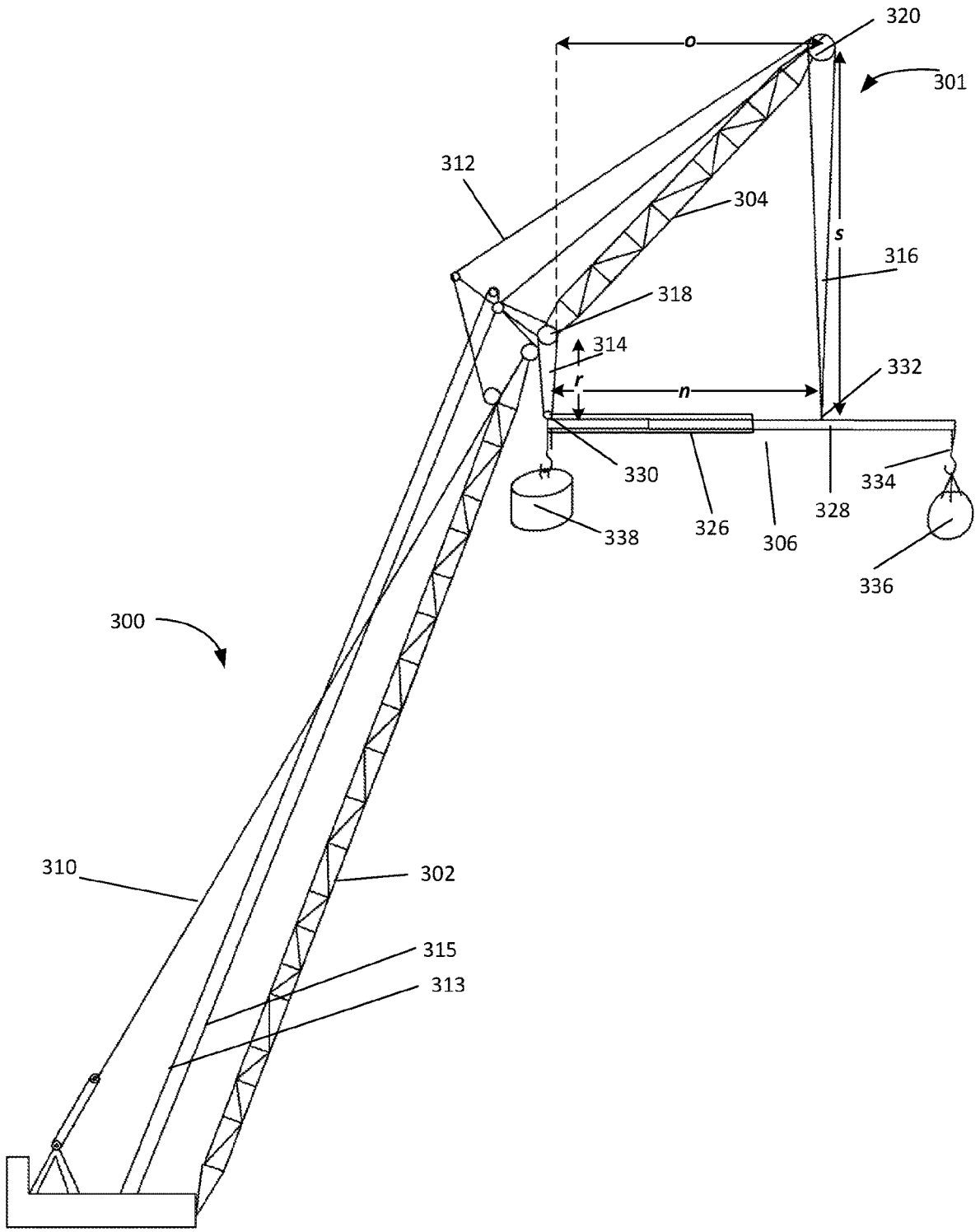
FIG. 12 is a schematic illustration of a tiltable boom crane with a tiltable jib attached to the distal end of the boom further equipped with a balanced feeding apparatus, constructed and operative in accordance with an additional embodiment of the present invention.

Reference is now made to FIG. 12, which is a schematic illustration of a tiltable boom crane, generally referenced 300, with a tiltable jib attached to the distal end of the boom further equipped with a balanced feeding apparatus, generally referenced 301, constructed and operative in accordance with a further embodiment of the present invention. Crane 300 includes a rotatable boom 302 with a slewing unit (not shown), a rotatable jib 304, and a horizontal fly beam 306. The slewing unit includes a gear and motor that manipulates guy lines, and a rope to control crane 300, e.g., boom guy line 310, jib guy line 312 and hoist ropes 313 and 315. Rotatable boom 302 rotates with adjustments of boom guy line 310. Rotatable jib 304 rotates with adjustments of jib guy line 312. Rotations in this context refer to the tilting of boom 302 and jib 304 in a vertical plane, while horizontal rotations, although possible or present, are not discussed. Grooved pulleys or sheaves 318 and 320 are located on jib 304, and are designed to lift and lower a load below jib 304 using hoist ropes or guy lines.

Crane 300 includes at least two hoisting assemblies, proximal hoisting assembly 314 and distal hoisting assembly 316. Hoising assemblies 314 and 316 are attached to sheaves 318 and 320 on jib 304. Sheaves 318 and 320 are separated by a lateral distance o. Balanced feeding apparatus 301 is similar to balanced feeding system 1 of FIG. 1, but without a trolley equivalent to trolley 10. A horizontal fly beam 306 hangs below jib 304 on upright hoisting assemblies 314 and 316, such as by hooks, at hanging points 330 and 332. Hanging point 330 is located near the end of fly beam 306 proximal to boom 302 and hanging point 332 is located further distally on fly beam 306. Hanging points 330 and 332 connect to sheaves 318 and 320 by hoist ropes 313 and 315, respectfully. Winches (not shown) for collecting and releasing hoist ropes 313 and 315 may be disposed also anywhere on boom 302. Hanging point 330 is a variable distance r from sheave 318. Hanging point 332 is a variable distance s from sheave 320. Motorized hoist winches (not shown) operate hoist ropes 313 and 315 to keep each hoist rope a deployed length r and s, respectively, and to synchronize lifting and lowering hanging points 330 and 332, while maintaining the balance of fly beam 306 (i.e., allowing lifting and lowering of fly beam 306, directly—without maneuvering boom 302 or jib 304, or in a more complicated manner in combination with tilting boom 302 and/or jib 304). A proximal portion 326 of fly beam 306 spans a distance n between hanging points 330 and 332 (which should be kept equal to distance o as further explained below). A distal cantilevered portion 328 of fly beam 306 extends beyond hanging point 332 (away from hanging point 330) and therefor extends beyond the remote tip of jib 304 (where sheave 320 is disposed).

A load securing member 334 is disposed at a distal end 328 of fly beam 324 beyond hoisting point 332. Hoisting module 334 is adapted for carrying a hanged load 336. Counterweight 338 is disposed at the proximal end of fly beam 306, in the vicinity of hanging point 330. Accordingly, only hanging point 332 may be a fulcrum about which fly beam 306 can pivot. A spontaneous counterclockwise (in the constellation of FIG. 9) pivot of fly beam 306 is not possible.

Fly beam 306 is manipulated either as a result of rotating crane 300 vertically (namely—tilting), while adjusting hoisting ropes 313 and 315. Rotating either boom 302 or jib 304 moves fly beam 306, and may result in the upsetting of the balance of fly beam 306. Boom 302 and jib 304 may synchronically tilt in a manner that maintains the balance of fly beam 306. For example, counteracting a clockwise rotation of boom 302 with a counterclockwise rotation of jib 304 maintains the balance of fly beam 306. Administering or collecting independent amounts of each hoist rope 313 and 315 adjusts distances r and s, respectfully, to keep fly beam 306 levelled and balanced. For example, dispensing hoist rope 315 from distal sheath 320 will increase distance s, which in turn will maintain the balance of fly beam 306 against a counterclockwise rotation of jib 304. In addition, hoist ropes 313 and 315 may be used to lift and lower fly beam 306.

The alignment of sheaves 318 and 320 with hoisting points 330 and 332, respectfully, is another important factor in balancing fly beam 306. The alignment of these elements is additionally dependent on the relation between distance n, the lateral distance between distal sheave 318 and proximal sheave 320, compared to distance o, the lateral distance between hoisting points 330 and 332. Distance n and distance o should be equal to maintain the balance of fly beam 306. Rotating jib 304, changes distance o but distance n remains constant. To adjust distance n, fly beam 306 may expand or contract between hoisting points 330 and 332, such as be by partially overlapping portions 326 and 328 that can move one with respect to the other. For example, to correct a shortening of distance o resulting from rotating jib 304 counterclockwise, fly beam 306 can correspondingly contract, decreasing distance n to be the same as distance o thereby maintaining the balance of fly beam 306. Similarly, at least one of hoisting apparatuses 314 and 316 (preferably 316) may be slidingly attached to fly beam 306 to adjust distance n. It is noted that fly beam 306 can be manipulated about a lateral axis (e.g., for insertion and retraction of its cantilevered portion 328 through on opening in a building) while remaining on a fixed vertical axis by rotating boom 302 or jib 304 simultaneously with a vertical adjustment of fly beam 306. It is further noted that such lateral manipulation may be combined with vertical lifting and lowering of fly beam 306 by tilting boom 302 and/or beam 304.

Figure 13:
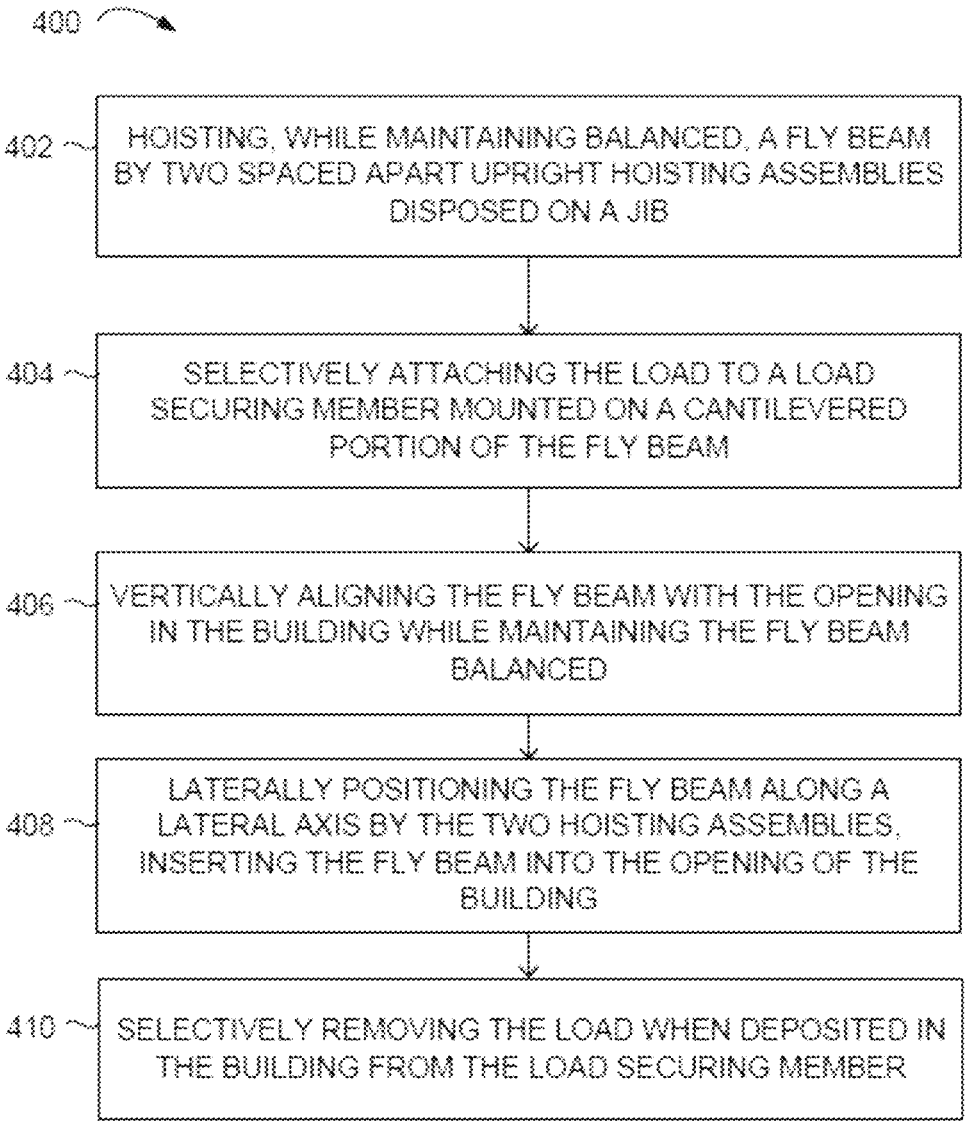
FIG. 13 is a flow chart of a method for facilitating the depositing of a load through an opening in a building using a cantilevered feeding apparatus, operative in accordance with an embodiment of the present invention.

Reference is now made to FIG. 13, which is a flow chart of a method for facilitating the depositing of a load through an opening in a building using a cantilevered feeding apparatus, operative in accordance with the invention. In procedure 402, a fly beam is hoisted while maintained balanced hoisting by two spaced apart upright hoisting assemblies disposed on a jib. With reference to FIG. 1, hoisting while maintaining balanced fly beam 13 is conducted by adjusting operate cables 28 and 29, which are attached to two spaced apart upright hoisting assemblies 21 and 22, which are disposed on jib 5. In procedure 404, a load is selectively attached to a load securing member mounted on a cantilevered extension portion of the fly beam. With reference to FIG. 1, selectively attaching load 19 to load securing member 18 is performed on a cantilevered extension of fly beam 13 extending beyond one of two hanging points 14 and 15, and counterweight 20 is attached to fly beam 13 in the vicinity the other of two hanging points 14 and 15.

In procedure 406, the fly beam is vertically aligned with the opening in the building while maintaining the fly beam balanced. With reference to FIG. 1, vertically aligning fly beam 13 with opening 32 in building 31 while maintaining fly beam 13 balanced is conducted by adjusting two upright hoisting assemblies 21 and 22.

In procedure 408, the fly beam is laterally positioned along a lateral axis by the two hoisting assemblies to insert the fly beam into the opening of the building. With reference to FIG. 1, laterally positioning fly beam 13 along a lateral axis is performed by two upright hoisting assemblies 21 and 22, for inserting fly beam 13 into opening 32 of building 31.

In procedure 410, the load is selectively removed, when deposited in the building, from the load securing member. With reference to FIG. 1, selectively removing load 19 is conducted once deposited in building 31, from load securing member 18.

The reverse service, namely-picking up a load through an opening in a building by a cantilevered feeding apparatus, is simply operated by analogously applying the same procedures in reverse order.

While certain embodiments of the disclosed subject matter have been described, so as to enable one of skill in the art to practice the present invention, the preceding description is intended to be exemplary only. It should not be used to limit the scope of the disclosed subject matter, which should be determined by reference to the following claims.

The invention claimed is:

1. A balanced cantilevered feeding apparatus for coupling with a jib, configured to facilitate depositing and removing of a load through an opening in a building, the balanced cantilevered feeding apparatus comprising:

two spaced apart upright hoisting assemblies disposed on said jib, wherein said jib is mounted with a slewing mechanism to said building above said opening or to an additional building facing said building;

a fly beam hoisted, balanced, and selectively positioned along a lateral axis by said two hoisting assemblies, said fly beam comprising:

at least one cantilevered extension portion extending beyond one of said two hoisting assemblies toward said building; and a load securing member mounted on said cantilevered extension portion positioned outwardly from said one of said two hoisting assemblies, said load securing member operational for engaging and supporting said load, allowing depositing and removing said load through an opening in said building when said fly beam is vertically aligned with said opening; and a counterweight connected to said fly beam in the vicinity of another of said two hoisting assemblies.

2. The balanced cantilevered feeding apparatus of claim 1, wherein said hoisting assemblies are configured to selectively position said fly beam along a lateral axis by at least one of:

sliding over said jib; and changing hoist height when said jib is tilted to change its inclination.

3. The balanced cantilevered feeding apparatus of claim 1, wherein said hoisting assemblies are adjustably spaced apart along said jib.

4. The balanced cantilevered feeding apparatus of claim 3, wherein said fly beam is adjustable in size to accommodate the changing lateral distance between said two hoisting assemblies on said jib.

5. The balanced cantilevered feeding apparatus of claim 1, wherein said jib is tiltably attached to the tip of a tiltable boom, and wherein said fly beam is laterally positioned by tilting for changing inclination of at least one of: said jib; and said boom.

6. The balanced cantilevered feeding apparatus of claim 5, wherein said jib tiltingly compensates for a tilt of said boom for maintaining the balance of said fly beam.

7. The balanced cantilevered feeding apparatus of claim 5, further comprising a hoist rope which is attached to and collected by one of said hoisting assemblies for maintaining the balance of said fly beam.

8. The balanced cantilevered feeding apparatus of claim 5, wherein at least one of said two hoisting assemblies slides with the tilting of at least one of said boom and said jib for maintaining the balance of said fly beam.

9. A method for facilitating depositing of a load through an opening in a building, said method comprising the procedures of:

mounting a jib to a slewing mechanism on said building above said opening or on an additional building facing said building, and slewing the jib during the depositing of the load;

hoisting, while maintaining balanced, a fly beam by two spaced apart upright hoisting assemblies disposed on a jib;

selectively attaching said load to a load securing member mounted on a cantilevered portion of said fly beam, said cantilevered portion extends beyond one of said two hoisting assemblies toward said building while connecting a counterweight in the vicinity of another of said two hanging points;

vertically aligning said fly beam with said opening in said building while maintaining said fly beam balanced, by vertically repositioning said fly beam by said two upright hoisting assemblies; and laterally positioning said fly beam along a lateral axis by said two hoisting assemblies, while maintaining said fly beam balanced; for inserting said cantilevered portion into said opening of said building; and selectively removing said load when deposited in said building, from said load securing member.

10. The method for facilitating depositing of a load of claim 9, wherein said procedure of hoisting while maintaining balanced comprises maintaining said fly beam balanced by at least one of:

sliding said hoisting assemblies over said jib; and changing hoist height when said jib is tilted to change its inclination.

11. The method for facilitating depositing of a load of claim 9, wherein said procedure of hoisting while maintaining balanced comprises adjustably spacing apart said hoisting assemblies along said jib.

12. The method for facilitating depositing of a load of claim 11, wherein said procedure of hoisting while maintaining balanced further comprises adjusting said fly beam is in size to accommodate the changing lateral distance between said two hoisting assemblies on said jib.

13. The method for facilitating depositing of a load of claim 9, further comprising the procedure of tiltably attaching said jib is to the tip of a tiltable boom, and laterally positioning said fly beam is by tilting for changing inclination of at least one of: said jib; and said boom.

14. The method for facilitating depositing of a load of claim 13, wherein said procedure of hoisting while maintaining balanced further comprises tiltingly compensating said jib for a tilt of said boom for maintaining the balance of said fly beam.

15. The method for facilitating depositing of a load of claim 13, wherein said procedure of hoisting while maintaining balanced further comprises attaching and collecting a hoist rope by one of said hoisting assemblies for maintaining the balance of said fly beam.

16. The method for facilitating depositing of a load of claim 13, wherein said procedure of hoisting while maintaining balanced further comprises sliding at least one of said two hoisting assemblies with the tilting of at least one of said boom and said jib for maintaining the balance of said fly beam.

* * * * *